US011771606B2

(12) United States Patent
Waskowicz

(10) Patent No.: US 11,771,606 B2
(45) Date of Patent: Oct. 3, 2023

(54) AMBULATORY ASSIST DEVICE

(71) Applicant: Caleigh M. Waskowicz, Southington, CT (US)

(72) Inventor: Caleigh M. Waskowicz, Southington, CT (US)

( * ) Notice: Subject to any disclaimer, the term of this patent is extended or adjusted under 35 U.S.C. 154(b) by 473 days.

(21) Appl. No.: 16/577,581

(22) Filed: Sep. 20, 2019

(65) Prior Publication Data

US 2020/0113759 A1 Apr. 16, 2020

Related U.S. Application Data

(60) Provisional application No. 62/733,701, filed on Sep. 20, 2018.

(51) Int. Cl.

| | |
|---|---|
| ***A61G 5/14*** | (2006.01) |
| ***A61H 3/04*** | (2006.01) |
| ***A61G 7/10*** | (2006.01) |

(52) U.S. Cl.

CPC ..... *A61G 5/14* (2013.01); *A61G 7/1017* (2013.01); *A61G 7/1046* (2013.01); *A61H 3/04* (2013.01); *A61G 7/1051* (2013.01); *A61H 2201/1652* (2013.01)

(58) Field of Classification Search

CPC ..... A61G 51/14; A61G 7/1017

See application file for complete search history.

(56) References Cited

U.S. PATENT DOCUMENTS

| | | | | | |
|---|---|---|---|---|---|
| 2,903,238 | A * | 9/1959 | Flandrick | A61G 7/1051 | 254/8 R |
| 2,991,485 | A * | 7/1961 | Schulte | A61G 7/1067 | 5/83.1 |
| 3,137,869 | A * | 6/1964 | Johnson | A61G 5/128 | 180/211 |
| 4,703,523 | A * | 11/1987 | James | A61G 7/1017 | D34/33 |
| 4,918,771 | A * | 4/1990 | James | A61G 7/1046 | 5/87.1 |
| 5,117,516 | A * | 6/1992 | Penner | A61G 7/1094 | 5/81.1 R |
| 5,309,584 | A * | 5/1994 | Parker | A61G 7/1017 | 5/87.1 |

(Continued)

*Primary Examiner* — Noah Chandler Hawk

(74) *Attorney, Agent, or Firm* — Armis IP Law, LLC

(57) ABSTRACT

An ambulatory assist device provides mobility assistance for an ambulatory transition between seated and standing positions. A mobile frame defines a structure similar to a walker device. The mobile frame includes a plurality of wheels for rolling communication with a ground surface. Lift arms, driven by an actuator, pivot around an axis of a cross member attached to the frame. The lift arm is configured for actuated pivotal movement for an ambulatory transition between seated and standing positions by a harness engaging the patient. The pivot is based on an arc of patient movement between the sitting and standing positions, such that the arc emulates natural movements of a human skeletal frame during an ambulatory transition. The patient experiences forces along the same path that an unassisted transition would encounter. Once in an ambulatory position, the device allows ambulatory movement in a manner similar to a walking assist (walker) device.

6 Claims, 4 Drawing Sheets

(56) References Cited

U.S. PATENT DOCUMENTS

| | | | | | |
|---|---|---|---|---|---|
| 5,365,621 | A * | 11/1994 | Blain | A61G 7/1046 | D12/128 |
| 5,845,348 | A * | 12/1998 | Dunn | A61G 7/1074 | 5/83.1 |
| 6,092,247 | A * | 7/2000 | Wilson | A61G 7/1061 | 5/81.1 R |
| 6,134,725 | A * | 10/2000 | Bouhuijs | A61G 7/1051 | 5/86.1 |
| 7,506,388 | B1 * | 3/2009 | Brown | A61G 7/1098 | 5/86.1 |
| 8,060,958 | B1 * | 11/2011 | Hough | A61G 7/1017 | 5/83.1 |
| 10,512,577 | B2 * | 12/2019 | Tsusaka | A61G 7/1017 | |
| 10,874,565 | B2 * | 12/2020 | Eriksson | A61G 5/14 | |
| 2006/0048297 | A1 * | 3/2006 | Mills | A61G 7/1067 | 5/86.1 |
| 2010/0154115 | A1 * | 6/2010 | Wernqvist | A61G 7/1096 | 5/86.1 |
| 2011/0056019 | A1 * | 3/2011 | Altena | A61G 7/1053 | 5/87.1 |
| 2012/0255118 | A1 * | 10/2012 | Hammond | A61G 7/1092 | 5/86.1 |
| 2015/0231005 | A1 * | 8/2015 | Gray | A61G 7/1098 | 5/83.1 |

* cited by examiner

AMBULATORY ASSIST DEVICE

RELATED APPLICATIONS

This patent application claims the benefit under 35 U.S.C. § 119(e) of U.S. Provisional Patent App. No. 62/733,701, filed Sep. 20, 2018, entitled "AMBULATORY ASSIST DEVICE," incorporated herein by reference in entirety.

BACKGROUND

The modern trend of increased average age results in an aging population with an increasing number of mobility compromised patients. A transition from a seated to standing position may be a formidable task for a mobility challenged patient, but can be facilitated by a patient lift device. The myriad of patient lifts on the market, however, tend to passivate patients by hindering participation in normal life activities. Such devices either lift patients vertically without allowing the natural forward motion of the transfer, or leverage the patient's knees against a stop while pulling them forward to create upward motion. Often, caregivers are even instructed to pull certain lifts backwards as the patient transitions to a standing position to allow them to travel through the necessary forward arc of motion. Patient handling and resulting caregiver injury is a leading cause of occupational injury because it is difficult for one person to lift another without undue exertion. Patient lifts are generally expensive, bulky and difficult to use. The average household simply cannot accommodate nor afford a lift and very few lift systems hold the patient up and then allow them to ambulate. Non-ambulatory patients are often relegated to a wheelchair and this lack of mobility further compromises their health. Patient falls and sliding onto the floor are common and typically require EMS assist in a floor to stand transfer even when no significant injury occurs, unduly burdening healthcare costs due to the required first responder calls.

SUMMARY

An ambulatory assist device provides mobility assistance for an ambulatory transition between seated and standing positions. A mobile frame defines a structure similar to a walker device. The mobile frame includes a plurality of wheels and is adapted for rolling communication with a ground surface. One or more lift arms are pivotable around an axis of a cross member substantially parallel to the ground surface, in which the cross member is attached to the frame for defining a lateral width. Multiple cross members and/or lateral bracing may be included for enhancing walker function. The lift arm is configured for actuated pivotal movement for an ambulatory transition between seated and standing positions by a tethered or hand grip interface to a patient. The cross member is disposed based on an axis defined by an arc of patient movement between the sitting and standing positions, such that the arc is based on natural movements of a human skeletal frame during an ambulatory transition. The patient therefore experiences forces along the same path that an unassisted seated/standing transition would encounter. The cross member is disposed based on a patient center of gravity during an ambulatory transition for providing a natural sense of balance during transition. Once in an ambulatory position, the mobile frame is adapted for movement along the ground surface in a manner similar to a walk assist (walker) device.

Configurations herein are based, in part, on the observation that the bulk and expense of conventional ambulatory aids limits effective deployment. Unfortunately, conventional approaches to stand assist devices suffers from the shortcoming that further ambulatory movement requires an additional device (i.e. walker) and corresponding transition. Bulky and/or heavy stand assist devices impose a further burden when the patient must be transitioned to a walker to enable self mobility. Accordingly, configurations herein substantially overcome the shortcomings of conventional bulky and/or cumbersome stand aids by providing an ambulatory assist device that provides both lift assistance for the ambulatory transition to a standing position, and ambulatory assistance as a rigid upright support, or walker device. In effect, the lift device is integrated in the walker device to allow unimpeded walker operation once the lift operation completes.

In the example configurations shown, setback arms attach to the lift arms, such that the setback arms are adapted for patient communication and also have a harness attachment. The setback arms provide a handhold for patient support during rolling communication with the ground surface, allowing operation as a walker device, and also include spring loaded hooks or other tethered attachments to assist in the ambulatory transition lift. Lift forces are provided by an actuator in communication with a fulcrum defined by the cross member axis, such that the actuator is operable to dispose the lift arm about the fulcrum. Any suitable actuation may be employed; in the example arrangements the actuator includes at least one of an electric motor, fluidic spring, mechanical spring and hydraulic pressure apparatus. The lift arms may also be responsive to slideable communication of retractable tethers over an apex pulley defined by a fixed crossmember, as the actuator draws tethers for disposing the lift arms into the upright, standing position.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The description below presents an example of a patient lift that operates as an ambulatory assist device that combines features of both a lift and a walker such that the device both transitions a patient from a seated to standing position and operates as a walker from the established standing position so that the patient does not need to transition to a separate device for ambulatory (walking) movement. The lift mechanism orients a harness around a natural center of gravity of the patient, and them provides lift support that follows a natural arc of movement based on a non-assisted transition (i.e. normal) sit-to-stand motion that a non-assisted person would perform.

The myriad of available, conventional patient lifts on the market passivate patients by preventing them from participating. The conventional devices either lift patients vertically without allowing the natural forward motion of the transfer or leverage the patient's knees against a stop while pulling them forward to create upward motion. Caregivers are even instructed to pull certain lifts backwards as the patient comes up to allow them to travel through the necessary forward arc of motion. Patient handling/caregiver injury is the leading cause of occupational injury. There is no generally safe way for one person to lift another. Patient lifts are expensive, bulky and difficult to use. The average household simply cannot accommodate nor afford a lift and very few lift systems hold the patient up and then allow them to ambulate. Non-ambulatory patients end up in a wheelchair and this lack of mobility further compromises their health. Patient falls and sliding onto the floor are common and typically require EMS assist to transfer floor to stand even when no significant injury occurs.

The disclosed ambulatory assist device, dubbed the "Stander Walker," presents a cost effective, safe, natural way to get from sit to stand and safely ambulate when physically compromised. It lifts patients from their center of gravity and along the natural arc of motion required without preventing them from participating and then provides as much support as they need while they ambulate. The device utilizes "Arc Assist Technology" and a "Center of Gravity" harness to pull the patient up from the proper lift point and through the natural arc of motion required to transfer from sitting to standing without completely preventing them from participating in the lift movement (passivation) and then supports the patient upright while allowing them to ambulate. This device is the next iteration of the rollator and minimizes caregiver and client injury risk. It does not leverage knees and is much less expensive than other patient lifts. This device is also capable of safely lifting a patient off of the floor if necessary.

Figure 1:
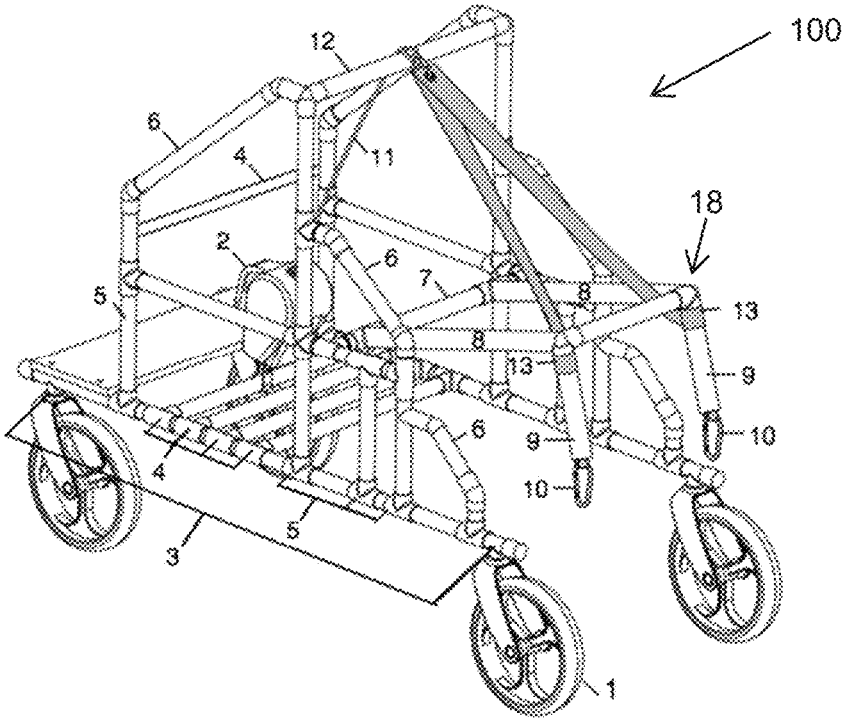
FIG. 1 is a perspective view of the ambulatory assist device corresponding to a seated position.

FIG. 1 is a perspective view of the ambulatory assist device corresponding to a seated position. Referring to FIG. 1, a frame 100 having a plurality of wheels 1 incorporates a power lift system 2, such as a motor, winch or actuator. It is height, width & weight adjustable to accommodate various body types. A lower frame assembly 3 is supported by a plurality of the wheels 1 adapted to contact the ground, floor or load-bearing surface on which the frame 100 is disposed. These wheels 1 can be locked to prevent the device from moving when motion is not desired. The frame 100 has a plurality of adjustable cross members 4 to allow for adjustment to patient size while providing support and anchor for the winch or other power lift mechanism and upright supports. A plurality of uprights 5 are mounted to the lower frame assembly 3 which support the patient and the patient lift system. The uprights 5 are adjustable to patient size. The lift system incorporates a fulcrum 7 that is located at the axis of a patient's normal arc of motion during a sit-to-stand transfer. This adjustable frame includes a plurality of stabilization brackets 6 and a cross member axis defined by the fulcrum 7. Two adjustable lift arms 8 extend from the axis which provide an ideal fulcrum and extend to two adjustable setback arms 9 that allow the patient room to move freely forward and backward while attached to the lift harness. A plurality of carabiners 10 or other attachment devices are affixed to the ends of the setback arms and allow easy attachment/detachment from the center of gravity harness. The power lift system 2 is appropriately anchored to the base and its lift strap, cable or other type of tether 11 passes over an apex 12 pulley and divides to attach to the distal ends 18 of the lift arms 8 at a junction 13 with the setback arms 9. This arc assist approach moves the patient through the natural arc of motion required to move from sitting to standing as depicted in the motion capture images in FIGS. 3A-3D below.

Figure 2:
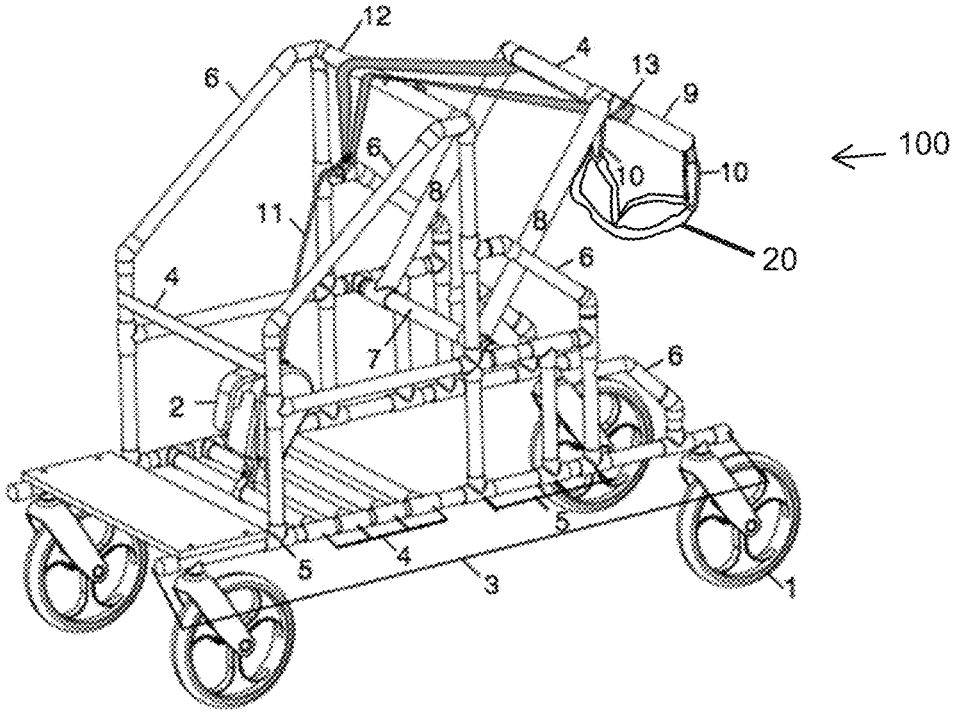
FIG. 2 shows the ambulatory assist device of FIG. 1 transitioning to a standing position.

FIG. 2 shows the ambulatory assist device of FIG. 1 during transition to a standing position. During the transition from a seated to a standing position, the assembly including the fulcrum, lift point, lift arm set back & power lift system applies a force for patients to naturally allowing their center of gravity to traverse the necessary forward arc and facilitates the use of the patient's own muscles & joints. This cost effective, compact and mobile device helps to retrain proprioception and motor memory while safely enabling caregivers to handle patient transfers and gait guarding. The configurations herein provide the features of a combined a patient lift system with an ambulatory assistive device & provides full support during ambulation to patients who would otherwise be unable to ambulate.

Referring to FIGS. 1 and 2, FIG. 2 depicts the stander walker in the up, or standing, position. In response to actuation of the power lift system 2, the lift arms 8 pivot upwards to a substantially vertical position. The perpendicular setback arms 9 attach to a harness 20 adapted to engage the waist or midsection of a patient at a natural center of gravity of the patient's mass. The setback arms 9 maintain a natural arc of movement as the lift arms 8 pivot to the upright, or standing position. The setback arms 9 also provide for sufficient clearance for the standing patient, otherwise the lift arms 8 alone would tend to draw the harness 20 into interference with the frame 100 at the apex 12.

The apex 12 may include a pulley or guide for the tether 11, or may simply glide against the frame in a low-friction engagement. In an alternate arrangement, shown below in FIGS. 5-8, the lift arms 8 pivot from a cantilever attachment around the fulcrum 7 or other pivoting engagement.

Figures 3A, 3B, 3C, 3D:
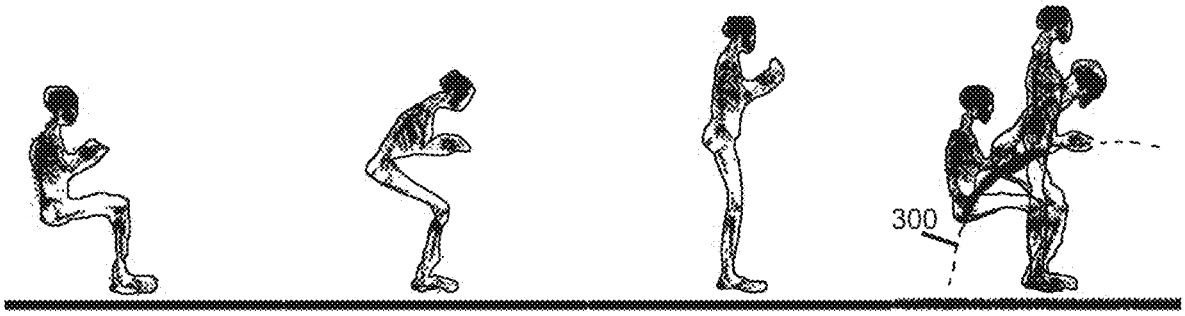
FIGS. 3A-3D show a profile of a patient employing the ambulatory assist device to transition to a standing position.

FIGS. 3A-3D show a profile of a patient employing the ambulatory assist device to transition to a standing position. FIGS. 3A-3D demonstrate the arc assist approach that moves the patient through the natural arc of motion required to move from sitting to standing. Referring to FIGS. 3A-3D, a seated (FIG. 3A) patient or user is characterized by a substantially perpendicular knee and another perpendicular orientation between the upper leg or femur to the upper torso. In a mobility challenged patient, transitioning to a standing position pivots these perpendicular orientations to straight, or 180 degree orientations in an upright standing position. FIG. 3B shows a midrange position between sitting and standing as the hips follow an arcuate path 300 as the knee angle opens. FIG. 3C shows the standing position, and FIG. 3D shows the intermediate movement that defines the arc 300 as the hips dispose along the arc 300 as the upper leg pivots substantially around an axis defined by the knee.

Figure 4A:
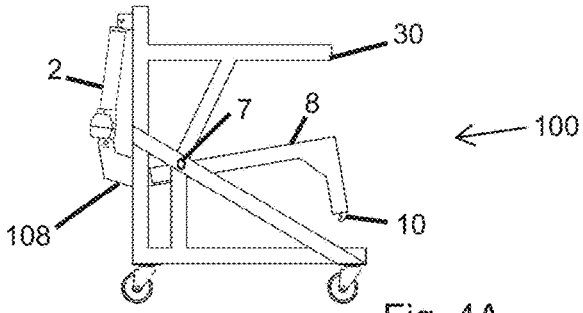
FIGS. 4A-4C show the device transitioning between the seated to standing positions.
Figure 4B:
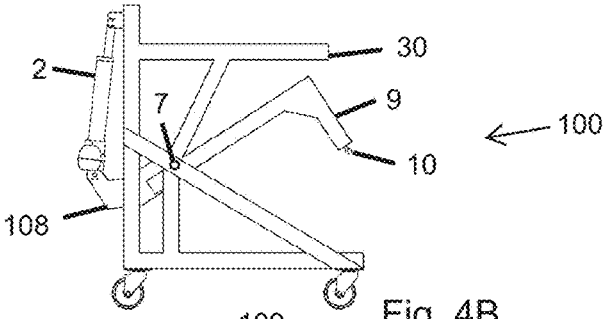
Figure 4C:
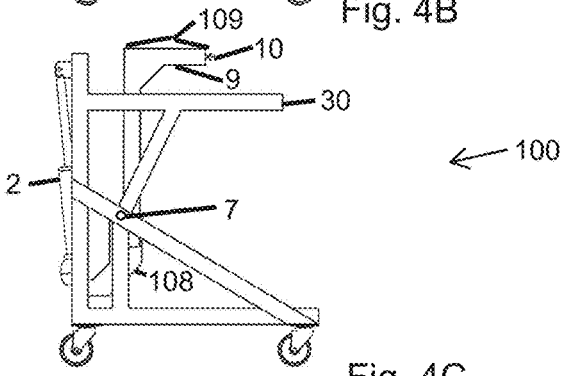

FIGS. 4A-4C show an alternate configuration including a cantilever arm 108 continuing from the lift arm 8 on an opposed side of the fulcrum 7 for cantilever movement. The power lift system 2 is defined by a linear actuator adapted to dispose the cantilever arm 108 downward to pivot the lift arm 8 upwards toward the standing position.

In FIGS. 4A-4C, the device transitions between the seated and standing positions. Referring to FIGS. 3A-4C, FIGS. 3A-3C correspond to the lift arm 8 and setback arm 9 positions in FIGS. 4A-4C. FIG. 4A shows a seated orientation where the lift arm 8 is near parallel with the ground surface and the carabiners 10/harness attachment are at a lowest position adapted to engage the seated patient of FIG. 3B.

FIG. 4B shows the upwards, arcuate movement of the lift arms 8 as the cantilever arm 108 is disposed downward, and FIG. 4C depicts the standing position as the lift arms 8 cantilever to a substantially perpendicular position as the setback arms attain the highest position. An offset distance 109 allows sufficient clearance for a standing patient between a distal end of the setback arms at the carabiners 10 and the now vertical lift arms 8.

The offset distance 109 also allows ample mobility room to permit access to the handholds 30 for allowing walker operation. It should be noted that once the lift arm 8 attains the vertical, standing position, the lift arm 8, offset arm 9, and power lift system 2 are now in a noninterfering position with the patient and the handholds 30 such that the frame 100 operates as a walker.

Figure 5:
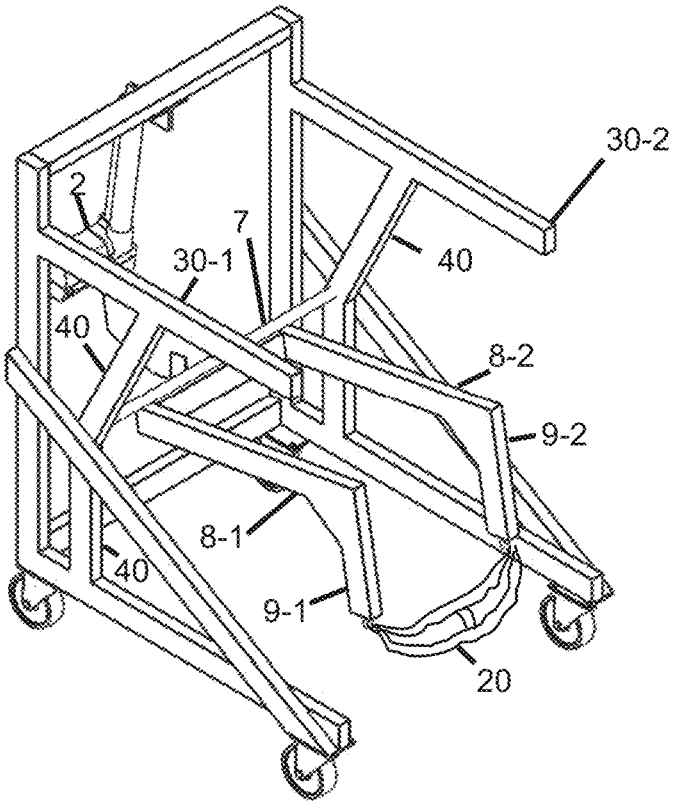
FIG. 5 shows a front perspective view of an alternate configuration corresponding to a seated position.

FIG. 5 shows a front perspective view of the alternate configuration corresponding to a seated position. Referring to FIGS. 4A-5, the perspective view of FIG. 5 depicts a plurality of lift arms 8-1 . . . 8-2 (8 generally), setback arms 9-1 . . . 9-2 (9 generally), and right and left handholds 30-1, 30-2 (30 generally) for walker operation. Any suitable number or arrangement of lift arms 8 and setback arms 9 may be employed for providing sufficient lift for the harness 20, however two provide an operational balance and distribution of load.

Figure 7:
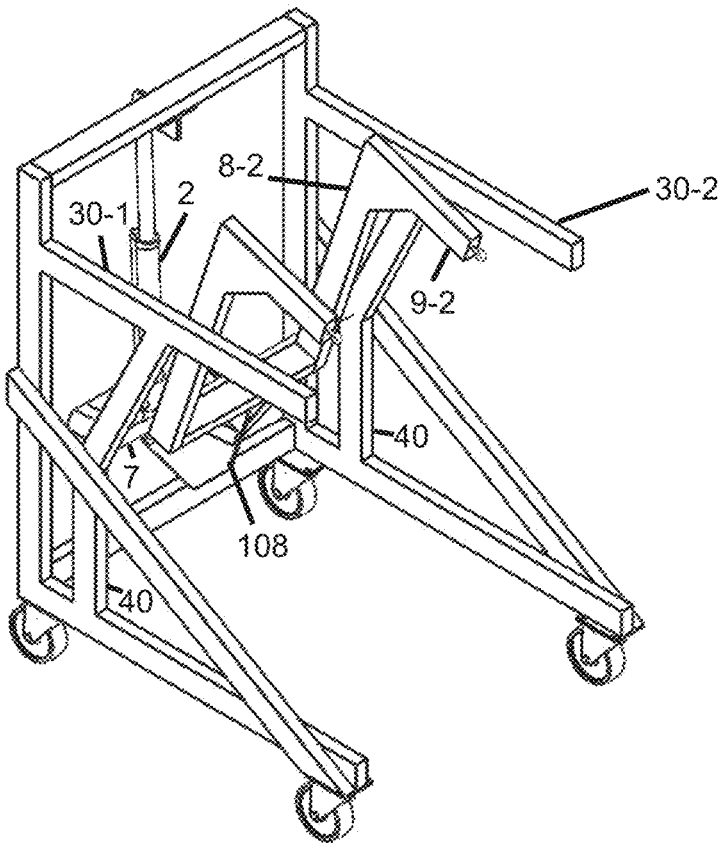
FIG. 7 shows a front perspective view of the device of FIG. 5 approaching a standing position.

In the ambulatory assist device of FIG. 5, the disclosed rest position is adapted to engage a mobility challenged patient. An ambulatory position, shown below in FIG. 7, is operable for wheeled manipulation and hand support of the mobility challenged patient as a walker appliance. The lift apparatus for transitioning the patient between the rest position and the ambulatory position includes a wheeled frame 100 having handholds 30 for engagement by an ambulatory patient, and an actuated lift arm 8 pivoting around a fulcrum 7. The fulcrum 7 attaches to a pair of uprights 40 between wheels 1 on the wheeled 100 frame and the handholds. A harness 20 attached to the lift arm 8 for lifting a patient load, the harness responsive to pivot upwards from downward movement of the actuated lift arm on an opposed side of the fulcrum, such that the actuator is operable to dispose the lift arm 8 between a horizontal and vertical position. The lift arm 8 has a length for disposing the harness 20 at a center of gravity of a patient load, and attaches to the setback arm 9 which extends substantially perpendicular from the lift arm 8. The setback arm 9 therefore extends parallel to a surface supporting the wheeled frame when the lift arm is in a vertical position, and is parallel to the handles 30 to enable the user to transition to grip the handles 30.

The setback arms 9 have a length based on a width for accommodating a standing patient when the lift arm 8 is in a vertical position, therefore providing clearance so that the retracting harness 20 does not compress the patient against the frame 100. The fulcrum 7 and lift arm 8 length therefore defining the arc 300 based on a patient transition from a sitting position to an ambulatory position.

The compact actuator is defined by lightweight construction that permits free ambulatory movement once the patient has achieved a standing position. The crossmember, lift arms and setback arms are adjustable for correspondence to a patient arc of motion and center of gravity. Force imposed by the actuator may be adjustable for partial supplement with a patient's own motor skills for encouraging natural anatomical strength building to complement physical therapy efforts. The degree of "lift" may therefore be adjusted such that the patient is not passively forced but rather exerts some musculoskeletal response to aid therapeutic mobility efforts.

Figure 6:
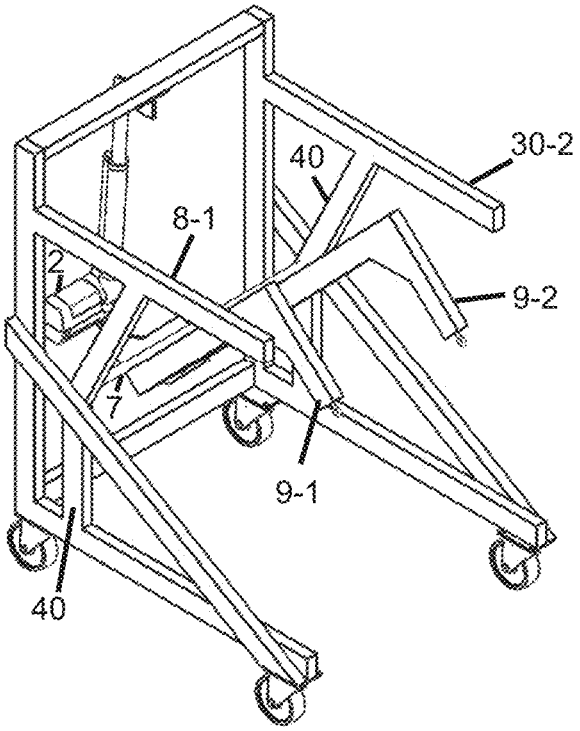
FIG. 6 shows a front perspective view of the device of FIG. 5 transitioning to a standing position.

FIG. 6 shows a front perspective view of the device of FIG. 5 transitioning to a standing position. Referring to FIGS. 3A-6, the upward movement of the lift arms 8 demonstrates movement of the offset arms 9 and harness 20 along the arc 300. The cantilever extension 108 can likewise be seen as it is driven downward by the power lift system 2 as it pivots about the fulcrum 7.

FIG. 7 shows a front perspective view of the device of FIG. 5 approaching a standing position. In FIG. 7, the setback arms 9 are drawn upwards adjacent the handles 30, such that a user engaged in the harness (omitted for clarity and visibility in FIGS. 6-8) can easily grasp the handles 30 for walker operation.

Figure 8:
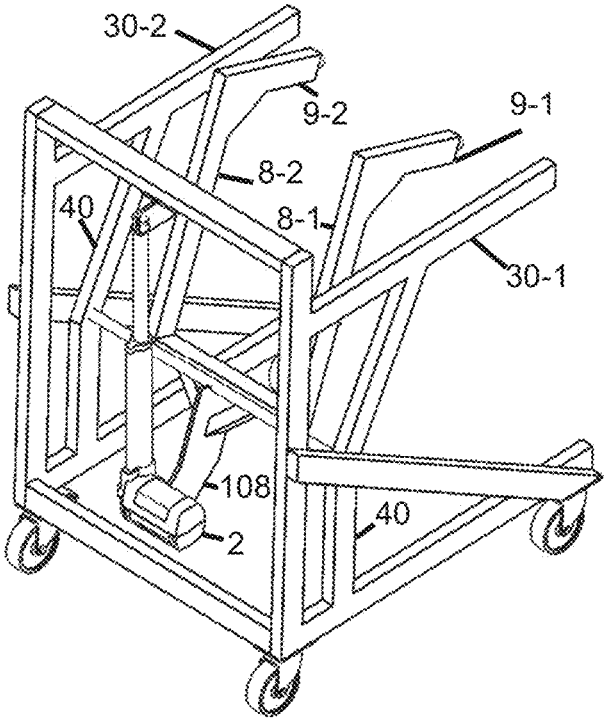
FIG. 8 shows a rear perspective view of the device of FIGS. 5-7.

FIG. 8 shows a rear perspective view of the device of FIG. 8. In FIG. 8, the near fully extended actuator of the power lift system 2 can be seen disposing the cantilever extension 108 downwards as the lift arms 8 approach vertical.

Various alternative to the power lift system 2 may be envisioned for drawing the harness 20 upwards along the arc 300. Linear actuators, hydraulic, pneumatic, screw drive, rotary winches and cables may be employed to provide the pivoting movement around the fulcrum 7 for driving the lift arm. Self contained power, such as from batteries or pressurized gas, is preferable, but an external connection to AC power or pneumatic sources, for example, could be detached once the patient is raised to a standing position and engages the handles 30 for walker operation.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. In an ambulatory assist device having a rest position and an ambulatory position, the rest position adapted to engage a mobility challenged patient and the ambulatory position operable for wheeled manipulation and hand support of the mobility challenged patient, a lift apparatus for transitioning the patient between the rest position and the ambulatory position, comprising:

a wheeled frame having handholds for engagement by an ambulatory patient;

an actuator attached to an actuated lift arm pivoting around a fulcrum, the fulcrum attached to an upright between wheels on the wheeled frame and the handholds, the fulcrum disposed based on an axis defined by an arc of patient movement between sitting and standing positions, the arc based on natural movements of a human skeletal frame during an ambulatory transition;

a harness attached to the lift arm for lifting a patient load, the harness responsive to pivot upwards from downward movement of the actuated lift arm on an opposed side of the fulcrum, the actuator operable to dispose the lift arm between a horizontal and vertical position;

the lift arm having a length for disposing the harness at a center of gravity of a patient load;

a plurality of setback arms rigidly attached and extending substantially perpendicular from the lift arm, the setback arm being rigid and extending parallel to a surface supporting the wheeled frame when the lift arm is in a vertical position, the setback arms adapted for patient communication by extending towards a rearward patient direction from the pivot axis and having a harness attachment for engaging the harness, a distal end of the setback arms at the harness attachment defining an unobstructed vertical position above the ground surface in the standing position, the setback arms disposing the harness horizontally distant from the axis when the lift arms are in a vertical position;

the setback arms having a length based on a region between the fulcrum and the harness attachment for accommodating a standing patient when the lift arm is in a vertical position; and the fulcrum and lift arm length defining an arc based on radial travel of the lift arm around the axis during a patient transition from the sitting position to the standing position corresponding to ambulatory movement.

2. The device of claim 1 wherein the setback arms provide a handhold for patient support during rolling communication with the ground surface.

3. The device of claim 1 wherein the actuator includes at least one of an electric motor, fluidic spring, mechanical spring and hydraulic pressure apparatus.

4. The device of claim 1 wherein the setback arms dispose the harness at a position for disposing the center of gravity of the load along the arc of patient movement.

5. The device of claim 1 further comprising a cantilever attachment between the actuator and the lift arm for disposing the lift arm about the fulcrum for transition between the seated and standing position.

6. The device of claim 1 wherein the lift arms define a circular arc of travel based on a circle centered at the axis with a radius defined by the lift arm.

* * * * *